United States Patent [19]

Brown et al.

[11] B 3,999,250

[45] Dec. 28, 1976

[54] METHOD OF FIBER DISTRIBUTION AND RIBBON FORMING

[75] Inventors: Roger S. Brown, New Orleans; James I. Kotter, Metairie, both of La.

[73] Assignee: The United States of America as represented by the Secretary of Agriculture, Washington, D.C.

[22] Filed: Apr. 18, 1975

[21] Appl. No.: 569,501

[44] Published under the second Trial Voluntary Protest Program on March 9, 1976 as document No. B 569,501.

Related U.S. Application Data

[62] Division of Ser. No. 404,976, Oct. 10, 1973, Pat. No. 3,902,224.

[52] U.S. Cl. ..... 19/155; 19/106 R

[51] Int. Cl.[2] ..... D01G 15/52

[58] Field of Search ..... 19/106, 150, 155, 151

[56] References Cited

UNITED STATES PATENTS

| | | | |
|---|---|---|---|
| 3,443,372 | 5/1969 | Eddleston | 19/106 X |
| 3,635,006 | 1/1972 | Fehrer | 19/150 X |

*Primary Examiner*—Dorsey Newton
*Attorney, Agent, or Firm*—M. Howard Silverstein; David G. McConnell; Salvador J. Cangemi

[57] ABSTRACT

By combination and interaction of mechanical and aerodynamic forces, textile fibers are doffed from a processing cylinder, purged of foreign matter, subdivided and directed into a network of conveying tubes, and distributed to a multiplicity of fiber by-passing condensers wherein fibers are continuously assembled into a uniform ribbon for subsequent textile processing. The invention encompasses unique means for by-passing excess fibers for collection and reprocessing.

1 Claim, 10 Drawing Figures

FIG. 8
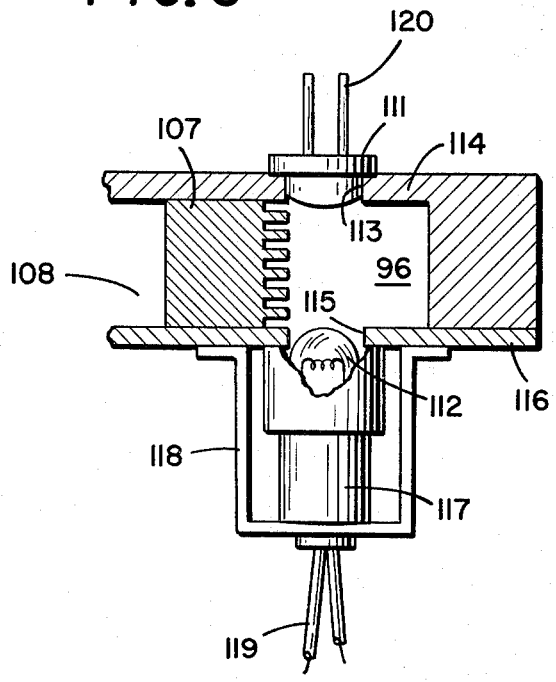
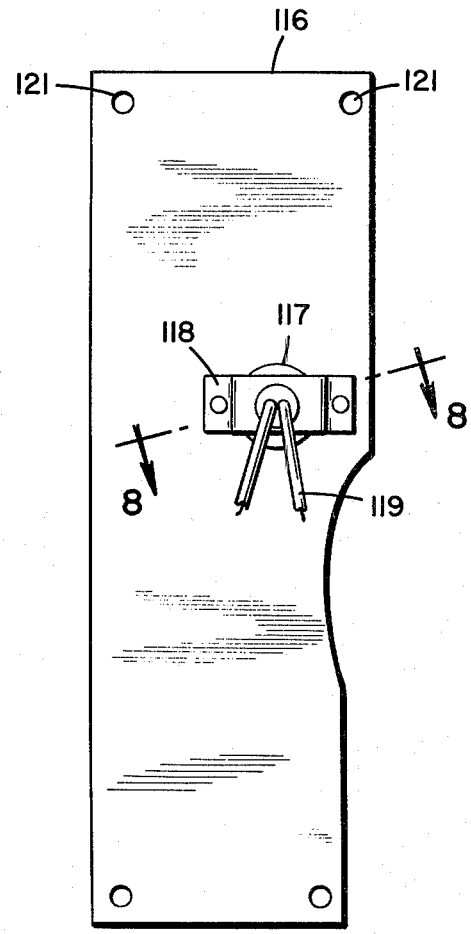
FIG. 9
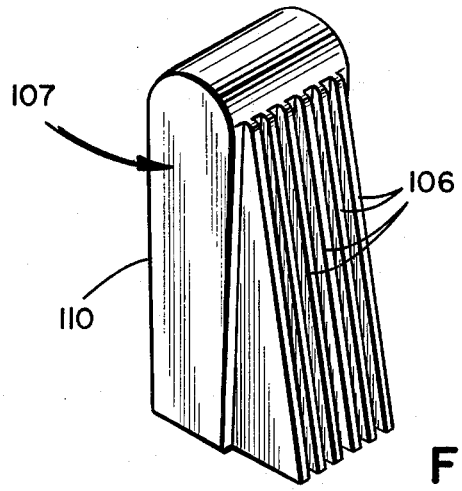
FIG. 7

METHOD OF FIBER DISTRIBUTION AND RIBBON FORMING

This is a division of application Ser. No. 404,976, filed Oct. 10, 1973, now U.S. Pat. No. 3,902,224.

This invention relates to a method and apparatus for the continuous formation of a multiplicity of uniform ribbons composed of fibers doffed from a textile processing cylinder.

More specifically, it relates to a method and apparatus for completely removing fibers from the surface of a textile processing cylinder, removing foreign matter content, e.g., seed fragments, motes, et cetera found in cotton, subdividing and transporting said fibers through a network of tubes to condensers wherein the fibers are assembled into identical ribbons for subsequent textile processing and wherein excessive amounts of fibers are by-passed for collection and reprocessing.

To those experienced in the art of textile processing, it is known that conventional methods of yarn production consist of many separate preparatory processing steps resulting in a non-continuous flow of fibers from initial opening to spinning, in distinctive strand formations, e.g., card, drawn and combed sliver, roving, et cetera, requiring numerous intricately designed machines, considerable labor, and a great expanse of textile mill floor area.

Presently, there is no existing commercial method of continuously forming a multiplicity of uniform fiber assemblages from a remotely located fibrous lap.

The principal object of this invention is to simplify textile processing by eliminating the carding, drawing, and roving processes without sacrificing yarn quality.

Another object of this invention is to eliminate manual handling and manual distribution of textile stock prior to spinning.

Another object of this invention is to provide an automatic means of distributing equal amounts of fibers from a fibrous lap to multiple locations for assembly into identical ribbons for subsequent processing.

Another object of this invention is to provide a means for producing a uniform ribbon of partially opened fibers for utilization in open-end spinning systems such as the Electrostatic Fiber Collector and Yarn Spinning Apparatus disclosed in U.S. Pat. No. 3,696,603.

This invention is a unique method of automatically subdividing, conveying, and distributing partially opened fibers from a fibrous lap to a multiplicity of fiber individualizing devices such as described in U.S. Pat. No. 3,685,100 developed for installation on open-end spinning frames.

A fibrous lap is fed to any conventional fiber opening device, e.g., a lickerin-type fiber opener with feed roll, feed plate, and processing cylinder. A unique manifold having multiple suction nozzles is the doffing, cleaning, and subdividing means whereby pertially opened fibers are pneumatically removed from the lickerin cylinder of the opening device purged of foreign matter, transported, and distributed through tubes to a multiplicity of fiber condensers.

By the interactions of centrifugal force, air under negative pressure and the adjacent flat surface of the suction nozzle manifold in close proximity to the rotating lickerin processing cylinder, foreign matter such as seed fragments, motes, et cetera found in cotton are removed as the fibers are doffed. As the fibers are pneumatically loosened and subsequently removed from the processing cylinder teeth, centrifugal force causes the heavier trash particles to negotiate a considerably wider arc than the lighter fibers require for entrance into each suction nozzle. Consequently, the manifold's adjacent flat surface deflects foreign matter away from the suction force and the nozzle entrance, and said foreign matter is permanently separated from the fibers.

Embodiments of said fiber condensers employ grid surfaces, fiber and air deflecting valves, sensing and control means, and combinations thereof to by-pass all fibers in excess of a predetermined amount used for ribbon formation.

After the partially opened fibers are subdivided by means of the suction nozzle manifold and pneumatically transported within tubes to by-passing condensers, said fibers are collected from the airstream by means of grid surfaces within each condenser.

A rotatable take-out cylinder peripherally covered with resilient material is located adjacent to and in contact with each fiber condenser forming a pneumatic seal. Said take-out cylinder, in close proximity to a grid surface within said condenser, rotating at a constant speed withdraws said fibers from the confines of said condenser, thus continuously forming a fibrous ribbon. A curved deflection plate in close proximity to said rotating takeout cylinder, serves as a guide for feeding the newly formed fibrous ribbon to a subsequent process.

Said fibrous ribbon production rate is governed by the rotational speeds of the take-out cylinder and the lickerin feed roll.

By-passed fibers are pneumatically conveyed under negative air pressure from a multiplicity of said condensers into a manifold through a plurality of inlets. Said fibers are further conveyed from the manifold to a fiber condenser of a conventional pneumatic fiber conveying system (not shown) for collection and reprocessing.

The blower of the said fiber conveying system provides the means for pneumatically conveying said fibers within this disclosure.

Further objects and advantages of the invention will be apparent from the following specifications, drawings, and claims set forth herein.

In the drawings:

FIG. 7 is a three dimensional view of a grid element utilized with condenser employing electrical means for controlling fiber by-passing.

FIG. 8 is a sectional view of the fiber condenser showing installation of the photoconductor cell and lamp in opposed sides of channel reservoir.

FIG. 9 is a side view of the fiber condenser cover with installed photoconductor cell.

Figure 1:
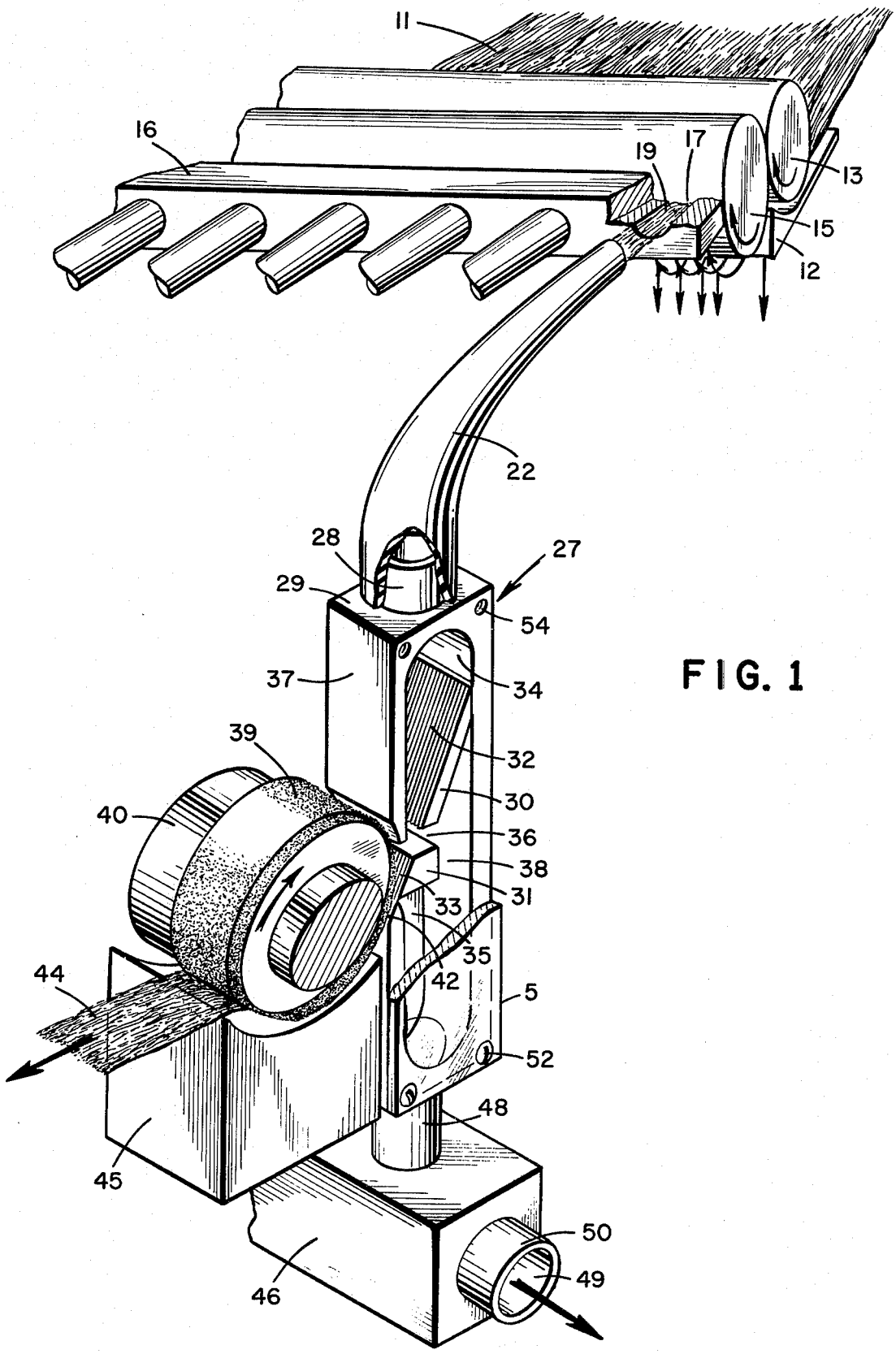
FIG. 1 is a three dimensional view of the invention with portions broken away to show internal construction. This view depicts an embodiment of the doffing manifold with in-line suction nozzles, and also an embodiment of a ribbon-forming, by-passing fiber condenser with two fixed grid elements for directing the flow of fibers into a reserve channel and/or into a fiber by-passing passage.
Figure 2:
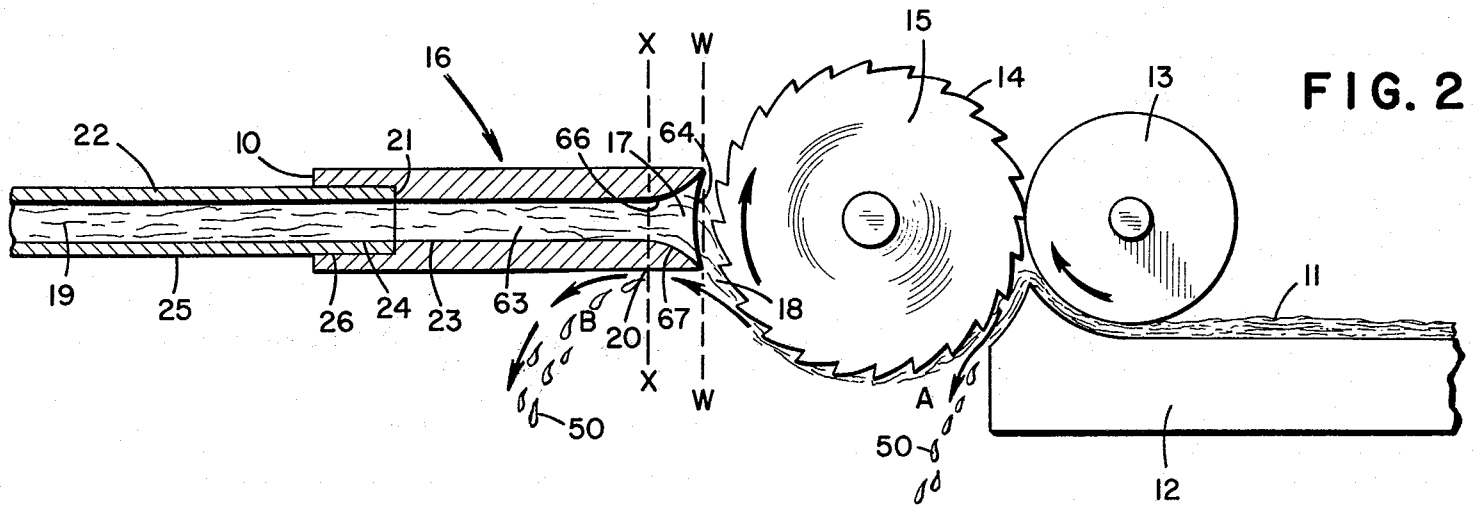
FIG. 2 is a side cross-sectional view of the suction nozzle manifold shown adjacent to lickerin processing cylinder. Foreign matter ejection areas are shown in this view.

Referring to our drawings, FIGS. 1 and 2 illustrate embodiments of the apparatus wherein a fibrous lap 11, supported by feed plate 12, is fed by a slow speed rotatably driven feed roll 13, to a lickerin cylinder 15, rotating at a relatively higher speed. Each forwardly raked tooth 14 of the rotating lickerin cylinder 15, extracts from the compressed fibrous lap 11, minute quantities of fibers 19. As this action occurs, some foreign matter entangled in the fibrous lap 11 is dislodged and ejected at Area A. Teeth 14 of lickerin cylinder 15, continuously transport the minute quantities of fibers 19 to "in-line" suction nozzle manifold 16.

As the fiber-laden teeth approach manifold 16, which is in close proximity to lickerin cylinder 15, air, aspirated by blower of conventional fiber conveyor system (not shown) entering suction nozzle 17 at air inlet 18 removes fibers 19 from teeth 14 and conveys said fibers 19 into suction nozzle 17 of manifold 16.

An appreciable amount of residual foreign matter 50 such as seed fragments, neps, leaf, et cetera, found in cotton is ejected as fibers 19 are pneumatically doffed from teeth 14 of lickerin cylinder 15. Said foreign matter 50 is deflected from surface 20 of manifold 16 in Area B.

Incorporated into manifold 16 are a multiplicity of identically functioning nozzles 17, adjacently aligned in the same plane, each concaved at entrance face 64, to match the peripheral curvature of lickerin cylinder 15.

Said entrance face 64, approximately rectangular at plane ww, transitions to circular passage 63 at plane xx with its inner walls 66 and 67 remaining non-parallel within the transition.

Width of manifold 16 corresponds to width of lickerin cylinder 15.

To accomplish efficient doffing of lickerin cylinder 15, suction air velocity must exceed peripheral surface velocity of cylinder 15.

Each nozzle 17 of manifold 16 is circumferentially recessed from discharge extremity 10 to inner face 21 to provide a snug fit sufficient to insure a pneumatic seal when circularly shaped tube 22 is inserted.

Outside diameter 25 of tube 22 and inner surface diameter 26 of recessed portion of nozzle 17 are approximately equal.

Inside diameter 23 of circular passage 63 and inside diameter 24 of tube 22 are identical.

Figure 3:
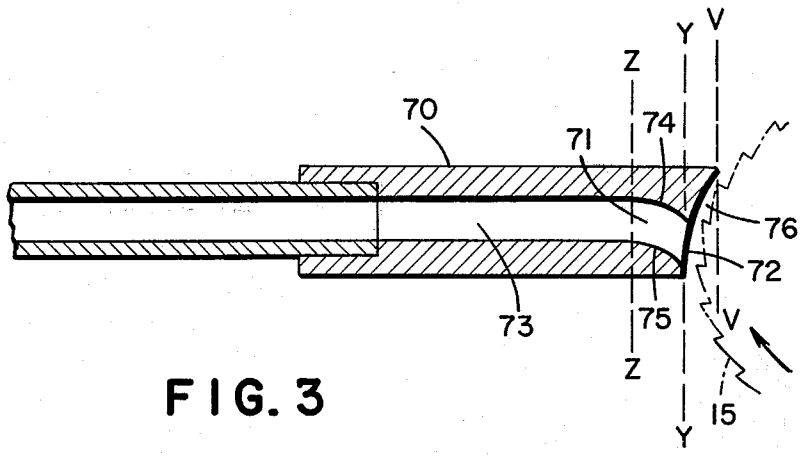
FIG. 3 is a side cross-sectional view of another embodiment of the suction nozzle manifold shown adjacent to lickerin processing cylinder.

Referring to FIG. 3, in this embodiment, incorporated into manifold 70 is a multiplicity of identically functioning nozzles 71, adjacently aligned in the same plane, each concaved at entrance face 72 to match the peripheral curvature of lickerin cylinder 15. Said entrance face 72 approximately rectangular at plane yy transitions to circular passage 73 at plane zz with its inner walls 74 and 75 remaining parallel within the transition. Entrance face 72 is extended from plane yy to plane vv to form an air seal and prevent unwanted air leakage through passage 76, thus improving the overall pneumatic doffing and operational efficiency.

Figure 4:
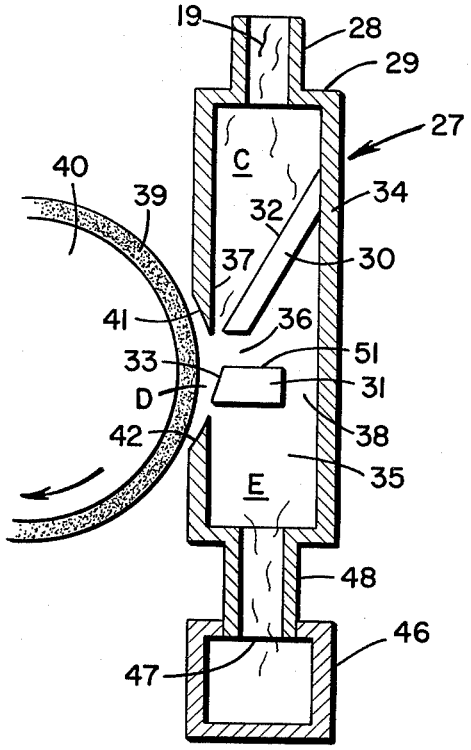
FIG. 4 is a side cross-sectional view of an embodiment of a ribbon-forming, by-passing fiber condenser attached to the manifold.

Referring to FIGS. 1 and 4, fibers subdivided by a multiplicity of nozzles 17 incorporated into manifold 16 are pneumatically transported to a corresponding number of ribbon-forming, by-passing condensers 27 by means of intermediate tubes 22.

Condenser 27 has a fixed, centrally located tubular projection 28 extending from its plane of entrance 29 to accomodate a snug fit, sufficient to insure a pneumatic seal when tube 22 encompasses said projection 28.

Within ribbon-forming, by-passing condenser 27, two sets of cantilevered, parallel bars 30 and 31 form grid 32 and partial grid 33 respectively. Cantilevered bars 30, forming grid 32, are attached to and extend from rear plenum wall 34. Partial grid 33 is attached to and extends from side plenum wall 35.

Surfaces of grid 32 and partial grid 33 are aligned tandemly in the same plane separated from each other providing fiber passage 36.

Between grid 32 and forward plenum wall 37, there exists ample clearance to permit passage of fibers 19 from said grid 32 onto grid 33.

Partial grid 33 and rear plenum wall 34 are separated to form passage 38.

Take-out cylinder 40 peripherally covered with resilient material 39 is adjacent to and in contact with matching curvatures 41 and 42 which define opening in forward plenum wall 37 of condenser 27, maintaining a pneumatic seal as it rotates.

As airborne fibers 19 are drawn into plenum C of condenser 27 by the action of the air suction force and the angularity and inclination of grids 32 and 33, said fibers are continuously compelled to collect in wedge area D, formed by grid 33 and resilient surface 39 of rotatably driven take-out cylinder 40.

When an excess of fibers 19 in Area D occurs, that is, when fibers 19 collect and build up to a height determined by surface 51, excess fibers 19 are instantly pneumatically conveyed through passages 36 and 38 into plenum E and subsequently out of ribbon-forming condenser 27.

By-passed fibers 19 are pneumatically conveyed under negative air pressure from a multiplicity of said condensers 27 into collection manifold 46 through a plurality of inlet openings 47.

Each fiber condenser 27 has a tubular projection 48 for attachment of said condenser 27 to manifold 46 at each of its inlet openings 47. Manifold 46 has fiber outlet 49 formed by tubular projection 50 onto which is connected suitable conduit for pneumatically transporting excess fibers 19 to any type conventional blower condensing unit, for collection and/or reprocessing.

Take-out cylinder 40, in close proximity to grid 33 is rotated to remove said fibers 19 from wedge area D, of condenser 27, forming a continuous fibrous ribbon 44 as said fibers 19 are urged between peripheral surface 39 and curvature 42 of forward plenum wall 37.

Curved deflection plate 45 in close proximity to said rotating take-out cylinder 40 confines and guides newly formed fibrous ribbon 44 to a subsequent process, i.e., a fiber individualizing apparatus disclosed in U.S. Pat. No. 3,685,100, used as a feeder for open-end spinning.

Cover 5 is attached to fiber condenser 27 by means of screws 52 inserted into tapped holes 54.

Figure 5:
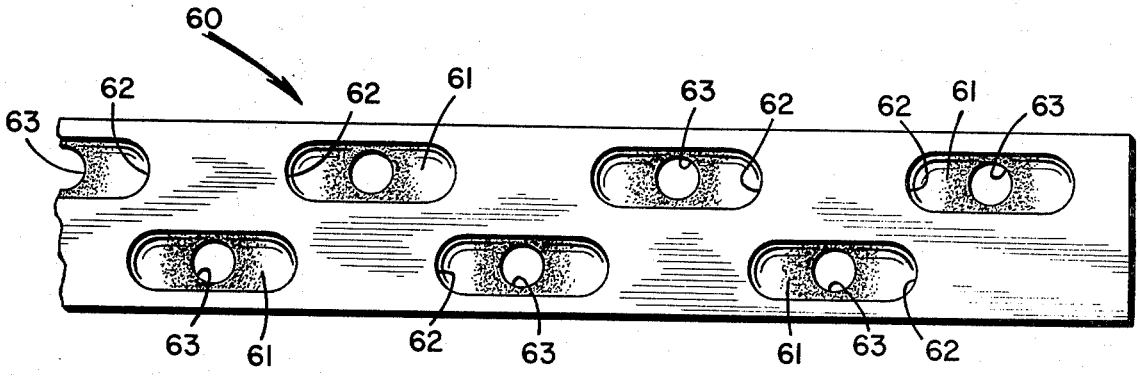
FIG. 5 is a front view of an embodiment of the doffing manifold with suction nozzles alternately arranged in double rows.

Referring to FIG. 5, to insure complete doffing of the lickerin cylinder at high production levels and to accomodate more ribbon-forming condensers in the system, manifold 60 of this embodiment has a multiplicity of aligned suction nozzles 61, equally spaced, alternately arranged offset in double rows. Suction nozzles 61 taper from an elongated, rectangularly shaped entrance 62 to circular passage 63.

Figure 6:
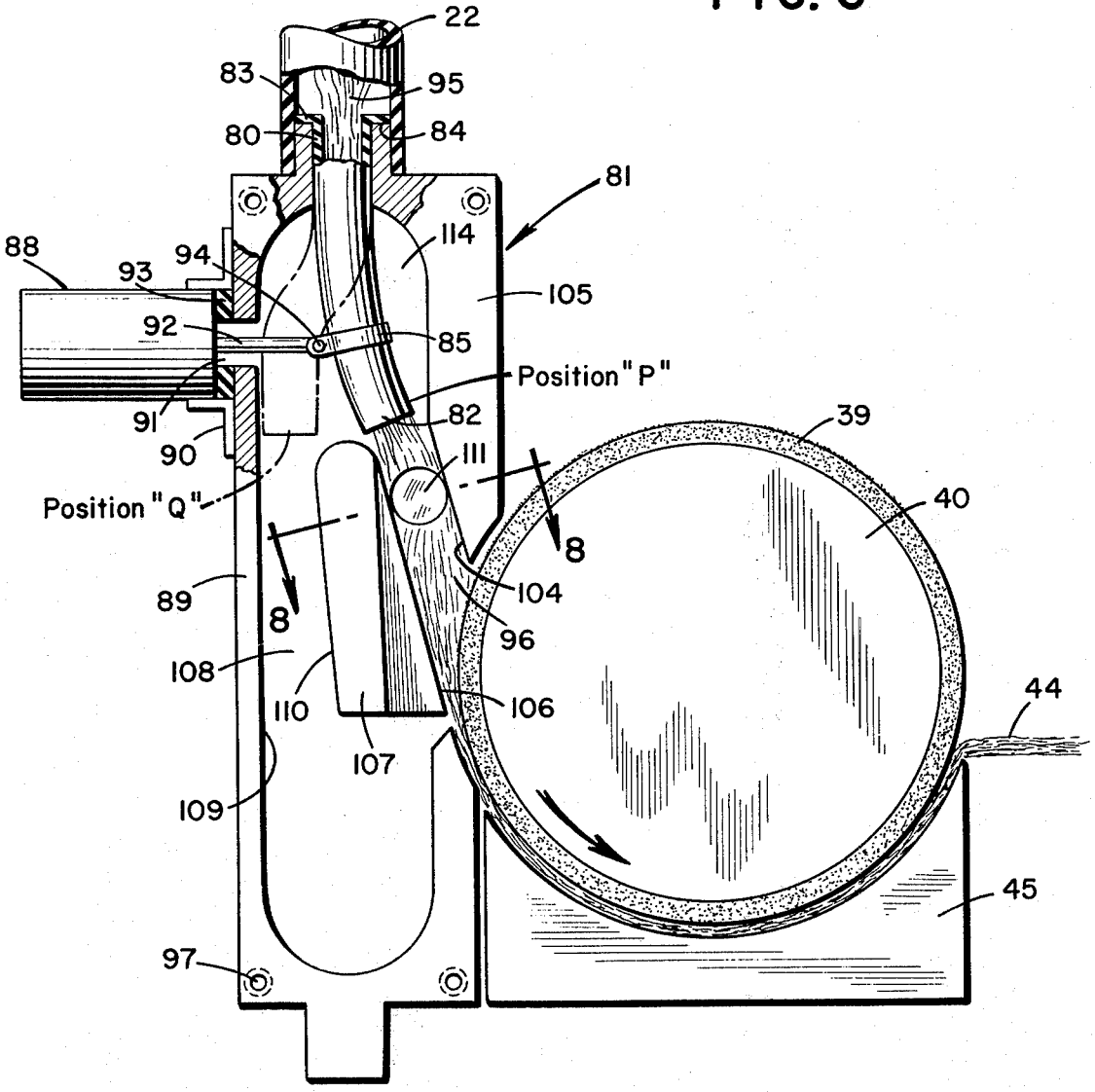
FIG. 6 is a side view with cover removed and with portions broken away to show internal construction of another embodiment of the ribbon-forming, by-passing condenser with electrical means for controlling uniformity in the fibrous strand.

Referring to FIG. 6, in this embodiment, electrical means is employed to accomplish positive fiber by-passing. Into tubular projection 80 of a modified by-passing condenser 81, flexible inner conduit 82 is snugly fitted. Affixed to conduit 82 is circular lip 83. Upon full insertion of conduit 82 into by-passing condenser 81, circular lip 83 contacts end surface 84 of tubular projection 80, thus serving as a means to secure conduit 82 to condenser 81 when flexible intermediate tube 22 encompasses said projection 80 of condenser 81.

Tube 82 fits into and is snugly held by clevis band 85. Spring return solenoid 88 is mounted to rear housing wall 89 of condenser 81 by means of clip angles 90. Through housing wall 89 is circular hole 91 to permit passage of solenoid rod 92. To provide pneumatic sealing, gasket 93 is fitted between housing wall 89 and solenoid 88.

Rod 92 is pivotably connected to clevis band 85 by means of pin 94. Pin 94 is locked into its functional position by any conventionally acceptable means.

With spring return solenoid 88 not activated, rod 92 is fully extended, placing flexible inner conduit 82 in position "P," compelling conduit 82 to direct the flow of fibers 95 into channel reservoir 96.

Referring to FIGS. 6 and 7, channel reservoir 96 is formed by surface 104 of forward housing wall 105 and surface 106 of grid element 107. Fiber by-passing passage 108 is formed by the separation of surface 109 of rear wall 89 and surface 110 of grid element 107.

Conduit 82 is of sufficient length to insure fiber deposition into grid reservoir 96 and into by-passing passage 108 without interference as said conduit 82 is moved into position "Q" by the action of solenoid 88 as it is electrically activated.

Referring to FIGS. 6, 8, 9, and 10, a fiber level sensing means such as photoconductor cell 111, mounted in circular opening 113, of side plenum wall 114, and a light emitting source such as lamp 112, mounted in circular opening 115, of cover 116 is employed to determine an excess amount of fibers 95 in the channel reservoir 96.

When the amount of fibers 95 reaches a predetermined level, and interrupts the flow of emitted light, photoconductor cell 111 causes relay 117 to close its normally open contacts and thus activate solenoid 88. When spring return solenoid 88 is actuated, conduit 82 is shifted to position "Q" by means of fully retracted rod 92. In position "Q" said conduit 82 is aligned with by-passing passage 108, thus by-passing the flow of fibers 95.

Lamp 112, inserted into conventional socket 117, supported by bracket 118, conventionally fastened to condenser 81, is connected into electrical circuitry (FIG. 10) by means of leads 119.

Photoconductor cell 111 is connected into electrical circuitry (FIG. 10) by means of leads 120.

Cover 116 is provided with holes 121 for attachment to condenser by means of screws (not shown).

Figure 10:
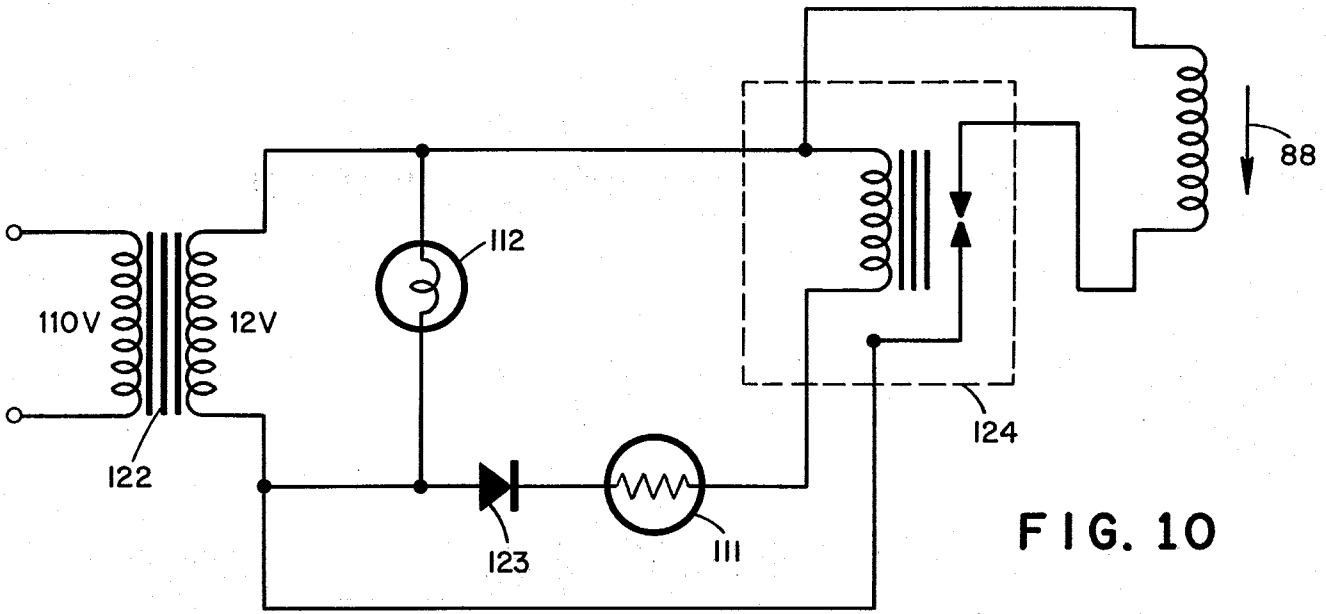
FIG. 10 is a schematic wiring diagram of the electrical means for controlling uniformity in the fibrous strand.

Referring to FIG. 10, transformer 122 reduces line voltage from 110 to 12 volts. Alternating current is changed to direct current flow by means of rectifier 123. When blockage of light emitted from lamp 112 to photoconductor cell 111 occurs, relay 124 is activated and closes its normally open contacts, thus energyzing spring return solenoid 88. Lamp 112 remains energized as long as voltage is applied to circuitry.

We claim:

1. A method for producing multiple uniform ribbons of fibers from a single source of fibers and subsequently feeding the strands severally to an associated but remotely located yarn spinning head assembly, said method comprising:

a. removing fibers pneumatically from a fiber opening and cleaning means and simultaneously purging any residual foreign matter from said fibers, b. Apportioning the removed fibers into a plurality of fiber streams and directing the streams severally to a corresponding plurality of pneumatic conveying tubes, c. conveying the fibers of each individual conveying tube to an associated fiber condensing means, d. assembling the fibers within each of said condensing means into a continuous fibrous ribbon, said ribbon adapted for subsequent processing, e. collecting and recycling any excess fibers from each of said condensing means to the opening and cleaning means.

* * * * *